US008408103B2

(12) United States Patent
Wu

(10) Patent No.: US 8,408,103 B2
(45) Date of Patent: Apr. 2, 2013

(54) ISOLATIVE TORQUE-EXERTING APPARATUS

(75) Inventor: Jih Chun Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 243 days.

(21) Appl. No.: 12/941,050

(22) Filed: Nov. 6, 2010

(65) Prior Publication Data

US 2012/0111159 A1 May 10, 2012

(51) Int. Cl.
*B25B 23/143* (2006.01)

(52) U.S. Cl. ..... 81/467; 81/483

(58) Field of Classification Search ..... 81/467, 81/472, 473, 477, 478, 479, 483
See application file for complete search history.

(56) References Cited

U.S. PATENT DOCUMENTS 4,485,703 A * 12/1984 Grabovac et al. ..... 81/483
5,497,682 A * 3/1996 Hsu ..... 81/483
6,334,377 B1 * 1/2002 Wu ..... 81/478

* cited by examiner

*Primary Examiner* — David B Thomas

(57) ABSTRACT

An isolative torque-exerting apparatus includes a wrench, a torque unit substantially located in the wrench, and an isolative unit provided on the wrench. The isolative unit includes a first isolative element for covering a portion of the wrench and a second isolative element for covering the remaining portion of the wrench. The first or second isolative element includes at least one cutout defined therein while the second or first isolative element includes a key located in the cutout.

3 Claims, 3 Drawing Sheets

ISOLATIVE TORQUE-EXERTING APPARATUS

BACKGROUND OF INVENTION

1. Field of Invention

The present invention relates to an isolative torque-exerting apparatus and, more particularly, to an isolative unit for a wrench.

2. Related Prior Art

Different hand tools are used for different tasks. Wrenches are often used to tighten or loose screws and nuts. Most wrenches are made of metal. Users might get electric shocks while working with such metal wrenches in environments where electrical elements exist.

As disclosed in Taiwanese Patent Publication No. 404306, a conventional socket wrench includes a handle coated with an isolative unit 11, and so is a socket. The isolative units 11 protect a user from an electric shock.

On the other hand, there are various adjustable-torque socket wrenches. An adjustable-torque socket wrench is equipped with a torque unit operable to adjust a maximum value of torque that can be exerted through the adjustable-torque socket wrench. There is however a problem with providing adjustable-torque socket wrenches with isolative units 11. The torque units are tested and, more particularly, calibrated before the adjustable-torque socket wrenches are delivered. The isolative units 11 deny access to the torque units. Some of the adjustable-torque socket wrenches that are proven to include problematic torque units cannot be corrected and must be dumped. This is a waste, and entails high costs in making such isolative adjustable-torque socket wrenches.

The present invention is therefore intended to obviate or at least alleviate the problems encountered in prior art.

SUMMARY OF INVENTION

It is the primary objective of the present invention to provide an isolative torque-exerting apparatus.

To achieve the foregoing objective, the isolative torque-exerting apparatus includes a wrench, a torque unit substantially located in the wrench, and an isolative unit provided on the wrench. The isolative unit includes a first isolative element for covering a portion of the wrench and a second isolative element for covering the remaining portion of the wrench. The first or second isolative element includes at least one cutout defined therein while the second or first isolative element includes a key located in the cutout.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
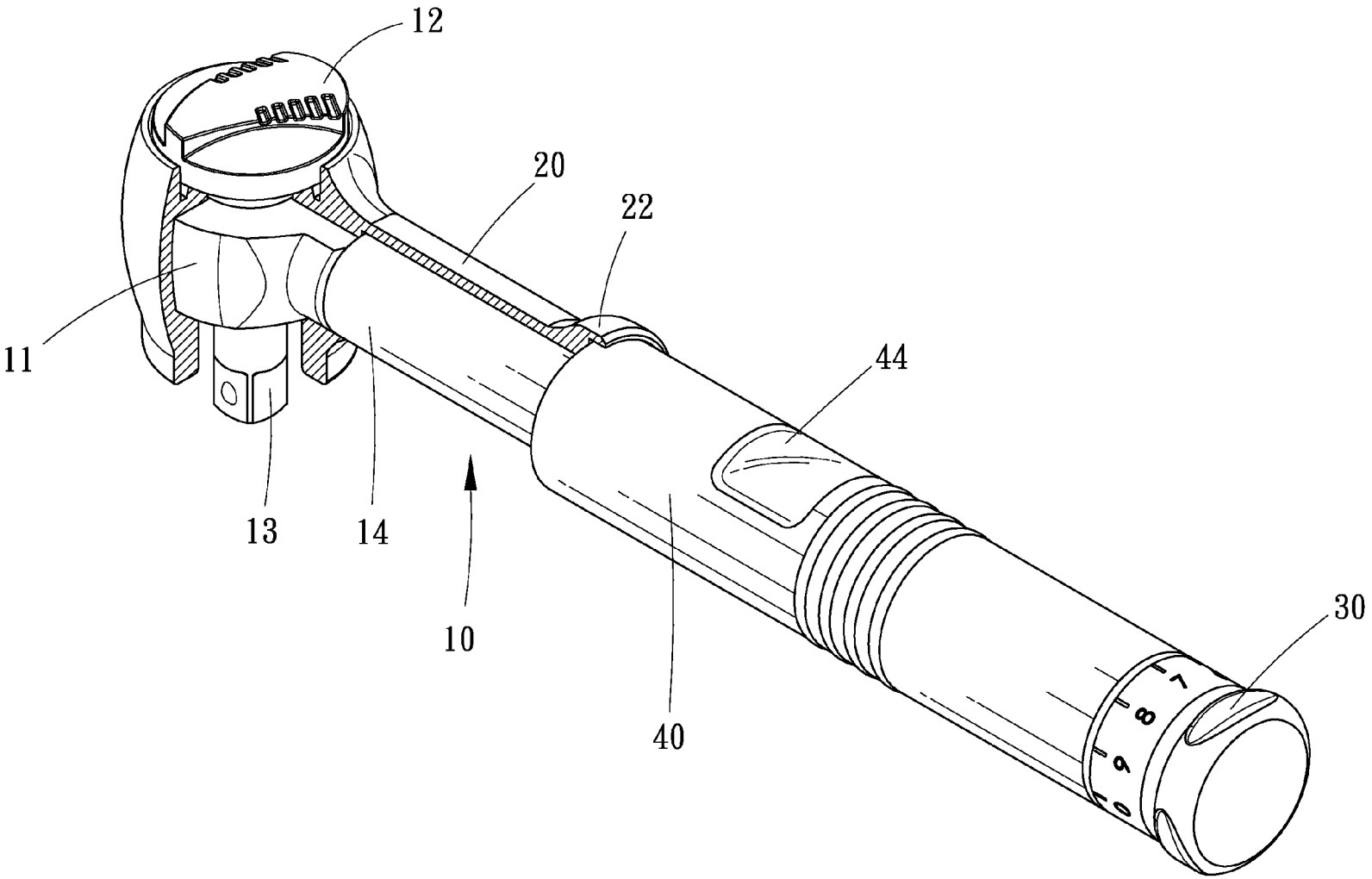
FIG. 1 is a cut-away view of an isolative torque-exerting apparatus according to the preferred embodiment of the present invention.
Figure 2:
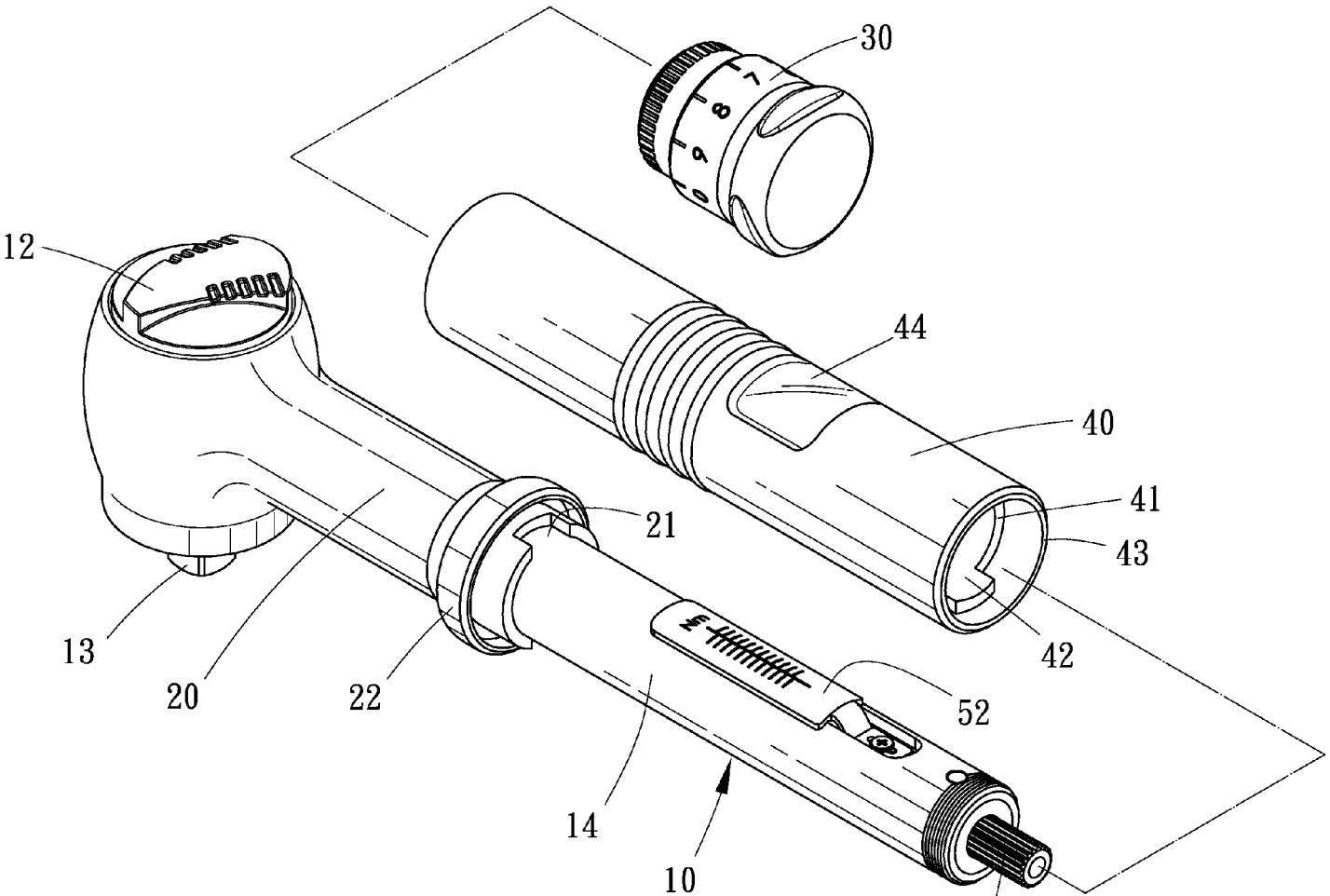
FIG. 2 is an exploded view of the isolative torque-exerting apparatus shown in FIG. 1.
Figure 3:
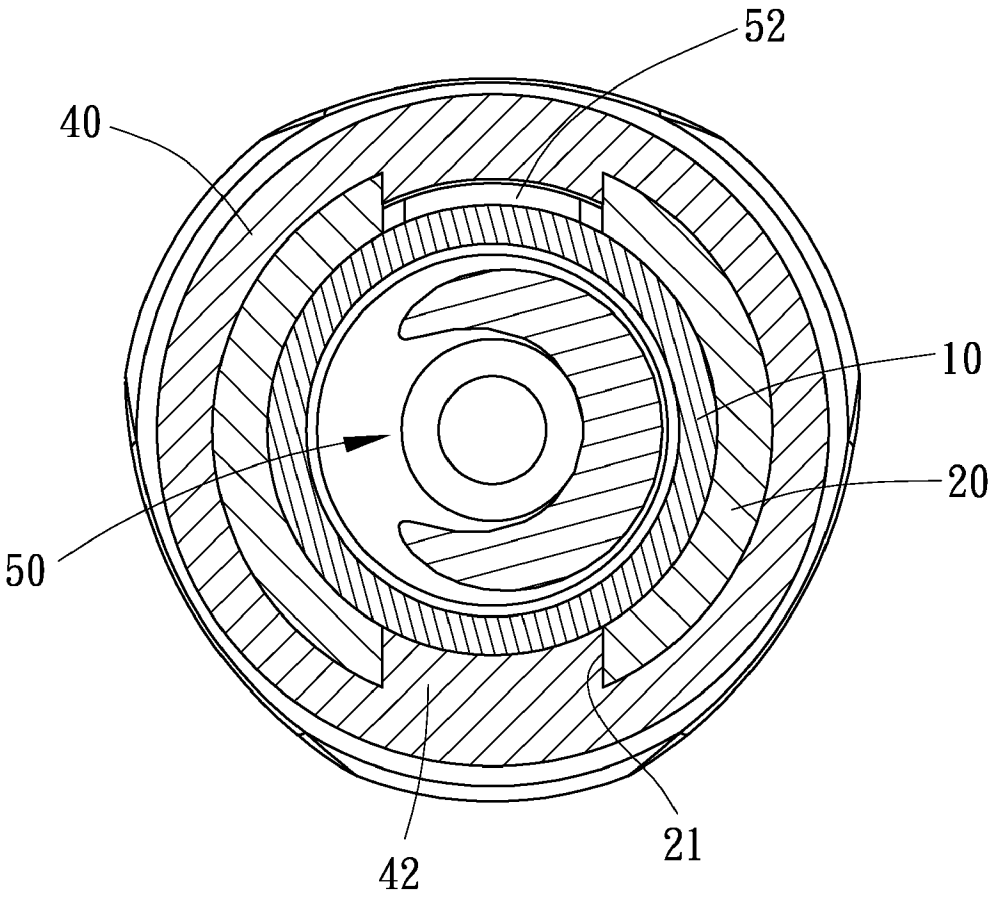
FIG. 3 is a cross-sectional view of the isolative torque-exerting apparatus shown in FIG. 1.

Referring to FIGS. 1 through 3, there is shown an isolative torque-exerting apparatus according to the preferred embodiment of the present invention. The isolative torque-exerting apparatus includes a wrench 10, a torque unit 50 located in the wrench 10, and an isolative unit provided on the wrench 10. The wrench 10 includes a head 11 formed at an end of a handle 14. A selective one-way driving unit is located in the head 11. The selective one-way driving unit is not described in detail for not being the spirit of the present invention. A switch 12 is located on an upper side of the head 11 and connected to the selective one-way driving unit. The switch 12 is made of an isolative material such as plastics. A square insert 13 is located on a lower side of the head 11 and connected to the selective one-way driving unit. By turning the switch 12, the handle 14 can be pivoted to spin the square insert 13 in a selected one of two directions through the selective one-way driving unit.

The torque unit 50 is located in the handle 14. The torque unit 50 however includes an axle 51 coaxially extending out of the handle 14 and a scale 52 located on the handle 14 and connected to the axle 51. A knob 30 is connected to the axle 51. By turning the knob 30, the axle 51 is spun and the scale 52 is moved on the handle 14 longitudinally. Thus, the maximum value of torque to be exerted through the wrench 10 is adjusted.

The isolative unit includes two isolative elements 20 and 40 both made of an isolative material such as plastics. The first isolative element 20 includes an annular portion and a tubular portion. The axis of the annular portion is perpendicular to that of the tubular portion. The first isolative element 20 further includes two cutouts 21 defined in the tubular portion and a skirt 22 formed on the tubular portion around the cutouts 21.

The second isolative element 40 includes a tubular wall 41 formed with a thin portion 43. The thickness of the thin portion 43 of the tubular wall 41 is smaller than that of the remaining portion of the tubular wall 41. In detail, the internal diameter of the thin portion 43 of the tubular wall 41 is larger than that of the remaining portion of the tubular wall 41 while the external diameter of the tubular wall 41 is constant throughout its length. Thus, a shoulder is formed on an internal side of the tubular wall 41, between the thin portion 43 of the tubular wall 41 and the remaining portion of the tubular wall 41. There are two keys 42. Each of the keys 42 extends from the shoulder in a longitudinal direction of the tubular wall 41 and extends from the internal side of the thin portion 43 of the tubular wall 41 in a radial direction of the tubular wall 41. The second isolative element 40 further includes a window 44 defined therein. The window 44 is covered with a lens.

The annular portion of the first isolative element 20 covers the head 11 but not the switch 12 and the square insert 13. Hence, the annular portion of the first isolative element 20 does not interfere with the operation of the switch 12 and the square insert 13. Moreover, the tubular portion of the first isolative element 20 covers a portion of the handle 14.

The second isolative element 40 covers the remaining portion of the handle 14. The thin portion 43 of the tubular wall 41 of the second isolative element 40 partially covers the tubular portion of the first isolative element 20. Now, the keys 42 are located in the cutouts 21 so that the isolative elements 20 and 40 cannot be spun relative to each other. Now, the skirt 22 of the first isolative element 20 partially covers the thin portion 43 of the second isolative element 20. The torque unit 50 is visible through the window 44.

The precision of the torque unit 50 would be reduced after some time of use. To tune the torque unit 50, the second isolative element 40 is detached from the handle 14 after the knob 30 is detached from the axle 51. After the tuning, the knob 30 is connected to the axle 51 after the second isolative element 40 is located around the handle 14 again. As discussed above, the torque unit 50 is tuned without having to break the isolative unit.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An isolative torque-exerting apparatus including:

a wrench;

a torque unit substantially located in the wrench; and an isolative unit provided on the wrench, wherein the isolative unit includes a first isolative element for covering a portion of the wrench and a second isolative element for covering the remaining portion of the wrench, wherein the first isolative element includes at least one cutout defined therein and a skirt formed thereon around the cutout, wherein the second isolative element includes a key located in the cutout as the second isolative element is partially located between the first isolative element and the skirt.

2. The isolative torque-exerting apparatus according to claim 1, wherein the second isolative element includes a thin portion located between the first isolative element and the skirt, wherein the key is formed on an internal side of the thin portion of the second isolative element.

3. An isolative torque-exerting apparatus including:

a wrench;

a torque unit substantially located in the wrench; and an isolative unit provided on the wrench, wherein the isolative unit includes a first isolative element for covering a portion of the wrench and a second isolative element for covering the remaining portion of the wrench, wherein one of the first and second isolative elements includes at least one cutout defined therein while the remaining one of the first and second isolative elements includes a key located in the cutout, wherein the second isolative element includes a window through which the torque unit is visible.

* * * * *